US007628130B2

(12) United States Patent
Johng

(10) Patent No.: US 7,628,130 B2
(45) Date of Patent: Dec. 8, 2009

(54) IGNITION SPARK PLUG

(76) Inventor: In Tae Johng, 954 dong, Venture valley, KIST 39-1, Hawolkok-dong, Sungbuk-ku, Seoul 136-791 (KR)

( * ) Notice: Subject to any disclaimer, the term of this patent is extended or adjusted under 35 U.S.C. 154(b) by 62 days.

(21) Appl. No.: 11/666,437

(22) PCT Filed: Jul. 26, 2006

(86) PCT No.: PCT/KR2006/002940

§ 371 (c)(1),
(2), (4) Date: Apr. 27, 2007

(87) PCT Pub. No.: WO2007/013765

PCT Pub. Date: Feb. 1, 2007

(65) Prior Publication Data

US 2009/0139479 A1 Jun. 4, 2009

(51) Int. Cl.
*H01T 13/20* (2006.01)
*H01T 13/46* (2006.01)
*H01T 13/54* (2006.01)

(52) U.S. Cl. ..... 123/169 EL; 123/169 PH; 313/123; 313/130; 313/141

(58) Field of Classification Search ..... 123/260, 123/266, 143 B, 152, 169 EL, 169 E, 169 PA, 123/169 PH; 313/123, 130, 139, 141–143
See application file for complete search history.

(56) References Cited

U.S. PATENT DOCUMENTS

| | | | | |
|---|---|---|---|---|
| 4,452,189 | A * | 6/1984 | Latsch et al. | 123/143 B |
| 4,795,937 | A * | 1/1989 | Wagner et al. | 313/130 |
| 4,914,343 | A * | 4/1990 | Kagawa et al. | 313/139 |
| 4,926,818 | A * | 5/1990 | Oppenheim et al. | 123/266 |
| 6,338,661 | B1 * | 1/2002 | Rossi | 313/141 |
| 6,460,506 | B1 * | 10/2002 | Nevinger | 123/260 |
| 2007/0069617 | A1 * | 3/2007 | Tozzi et al. | 313/140 |
| 2007/0119409 | A1 * | 5/2007 | Johng et al. | 123/169 EL |

FOREIGN PATENT DOCUMENTS

| | | | | |
|---|---|---|---|---|
| FR | 2451121 | A1 * | 11/1980 | 313/123 |

* cited by examiner

*Primary Examiner*—Willis R Wolfe, Jr.
(74) *Attorney, Agent, or Firm*—Rabin & Berdo, PC

(57) ABSTRACT

An ignition plug is disclosed which includes a hollow main cell having a bendable extension part and a primary combustion chamber, an insulator mounted in the main cell, to insulate a terminal rod centrally embedded in the main cell, a central electrode having a first electrical contact arranged in the primary combustion chamber, the central electrode extending downwardly from the terminal rod while being surrounded by the insulator, a second electrical contact provided at a lower inner surface of the main cell while being arranged in the primary combustion chamber, the second electrical contact corresponding to the first electrical contact, and a cross flame ignition valve coupled to the main cell by the extension part in a bent state of the extension part, the cross flame ignition valve having a main ignition hole and auxiliary ignition holes for guiding flames from the primary combustion chamber to an interior of a cylinder.

11 Claims, 2 Drawing Sheets

[Fig. 1]
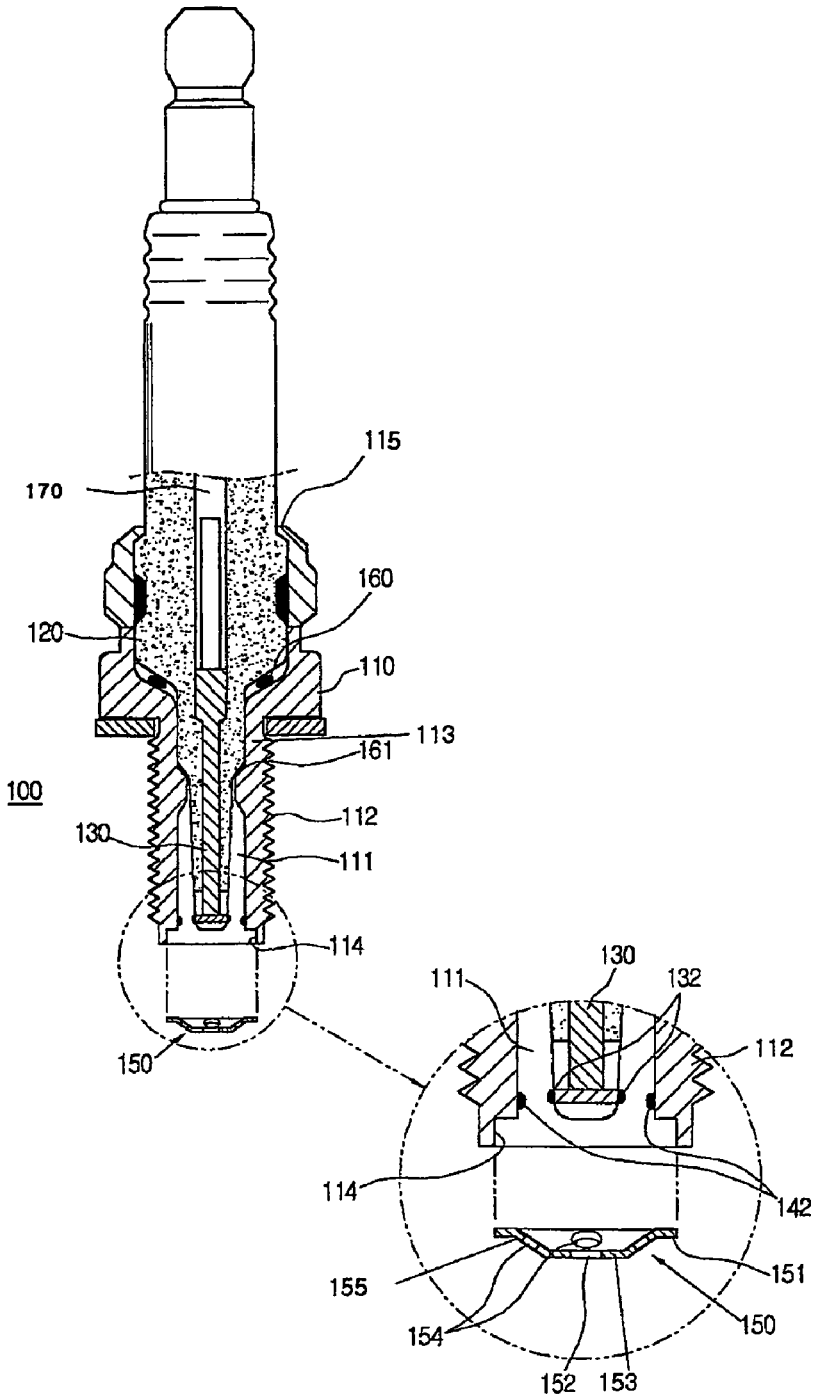
[Fig. 2]
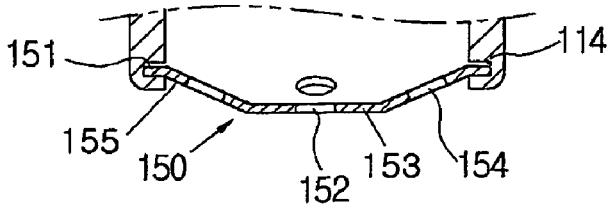

[Fig. 3]
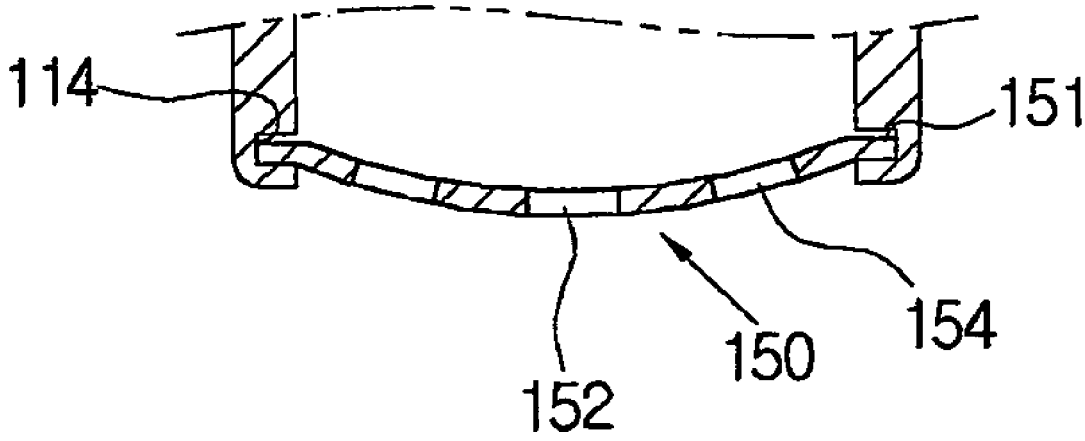

IGNITION SPARK PLUG

TECHNICAL FIELD

The present invention relates to an ignition device, and more particularly, to an ignition plug for an internal combustion engine which is capable of enhancing the combustion performance of the combustion engine and reducing a generation of nitrogen oxides (NOx), while being used for a prolonged period of time.

BACKGROUND ART

Internal combustion engines, which are mainly used as vehicle engines, may be classified into a 4-cycle engine and a 2-cycle engine. The 4-cycle engine has a compression stroke, a suction stroke, a combustion stroke, and an exhaust stroke.

Such an internal engine uses an ignition plug in order to burn a gas mixture in a combustion stroke. That is, the ignition plug means a spark discharge device for igniting a gas mixture compressed in an internal engine.

Generally, where such an ignition plug is used in spark ignition type internal combustion engine using high-octane gasoline, the ignition timing point of the ignition plug should be determined depending on the rotating speed of the internal combustion engine, in order to obtain a combustion efficiency for an appropriate output power required in the high-performance internal combustion engine.

For example, when the rotating speed of the internal combustion engine is low, ignition is carried out at the point of time corresponding to a crankshaft angle of about −6° from a top dead center (TDC), namely, a position earlier than the TDC by an angle of about 6° As the rotating speed of the internal combustion engine increases, the ignition timing point is further earlier than the TDC. That is, when the rotating speed of the internal combustion engine increases, an advanced ignition is carried out to obtain a maximum engine output power. Although the point of time when the advanced ignition is generated depends on the rotating speed of the internal combustion engine, the advanced ignition is typically generated at an angle of about −50° from the TDC Meanwhile, the internal combustion engine is provided with an electronic control unit (ECU) for controlling the air-fuel ratio between the amount of sucked air and the amount of injected fuel in the internal combustion engine. In detail, the ECU controls the amount of injected fuel and the ignition timing point, based on the revolutions per minute (RPM) of the engine, the amount of sucked air, and the pressure of sucked air. The ECU also has a regulation function for suppressing emission of unburned hydrocarbon (HC), carbon monoxide (CO), etc. while improving the maximum air-fuel ratio of the internal combustion engine. Thus, the ECU functions to optimize the performance of the engine.

However, the mechanism for obtaining the maximum output power of the engine cannot reduce nitrogen oxides (NOx) harmful to the human body. In particular, the problem caused by nitrogen oxides (NOx) becomes more severe in vehicles using LPG (a gas mixture of propane and butane).

In order to reduce nitrogen oxides (NOx) to an appropriate environmental pollution limit or less, an expensive three-way catalytic converter may be attached to an appropriate region of a system from which exhaust gas is discharged. The three-way catalytic converter controls emission of nitrogen oxides (NOx) to be a standard limit or less.

In this case, however, unburned hydrocarbon is accumulated due to the three-way catalytic converter. As a result, the system may be blocked or damaged.

Recently, for an improvement in engine performance, an ignition plug has been proposed which has a pre-combustion chamber structure in the form of an encapsulated structure, a tube-shaped structure, or a cover-attached structure.

However, the proposed structures incur a reduction in fuel efficiency, misfire caused by overheat at the TDP, and abnormal ignition. As a result, there is another problem such as a reduction in output power or a degradation in operation performance in the case of a high-performance engine.

Furthermore, the lower end of the pre-combustion chamber in such an ignition plug for example, an encapsulated cover, may be overheated beyond the heat exchange capability of the ignition plug namely, the heat range of the ignition plug due to high-temperature heat and vortex heat source gas present in the cylinder. Due to such overheat, detonation such as earlier ignition in a compression stroke may occur. As a result, a phenomenon that the engine is abruptly stopped may occur.

DISCLOSURE OF INVENTION

Technical Problem

Although the conventional ignition plug is provided with the above-mentioned pre-combustion chamber, it cannot achieve a desired improvement in combustion performance because a small amount of flamelets are transferred to the combustion chamber. Furthermore, the encapsulated cover arranged at the lower end of the ignition plug may be melted due to high-temperature heat and flames. As a result, there is a problem of a reduction in the life span of the ignition plug or a failure of the ignition plug.

In particular, such problems occur frequently in internal combustion engines using LPG gas or high-octane gasoline. Therefore, it is necessary to develop an ignition plug having a heat range meeting the high performance requirements of internal combustion engines.

Technical Solution

An object of the present invention devised to solve the above-mentioned problems lies in providing an ignition plug having an improved structure capable of extending the life span of the ignition plug.

Another object of the present invention lies in providing an ignition plug exhibiting an excellent heat exchange performance even in high-temperature and high-pressure environments.

Still another object of the present invention lies in providing an ignition plug capable of achieving an improvement in combustion rate and a reduced emission of nitrogen oxides.

In accordance with one aspect, the present invention provides an ignition plug comprising: a hollow main cell having a bendable extension part formed at a lower end of the main cell, and a primary combustion chamber formed above the extension part; an insulator mounted in a hollow portion of the main cell, to insulate a terminal rod centrally embedded in the main cell; a central electrode having a first electrical contact arranged in the primary combustion chamber, the central electrode extending downwardly from the terminal rod while being surrounded by the insulator; a second electrical contact provided at a lower inner surface of the main cell while being arranged in the primary combustion chamber, the second electrical contact corresponding to the first electrical contact; and a cross flame ignition valve coupled to the lower end of the main cell by the extension part in a bent state of the extension part, the cross flame ignition valve having a main ignition hole and auxiliary ignition holes for guiding flames from the primary combustion chamber to an interior of a cylinder.

The cross flame ignition valve may include a ring-shaped rim portion, and a disc-shaped central portion having a height lower than a height of the rim portion.

In accordance with another aspect, the present invention provides an ignition plug comprising: a hollow main cell having a primary combustion chamber defined in an interior of the main cell, and a bendable extension part formed at a lower end of the main cell; an insulator mounted in a hollow portion of the main cell, to insulate a terminal rod centrally embedded in the main cell; a central electrode having a first electrical contact arranged in the primary combustion chamber, the central electrode extending downwardly from the terminal rod while being surrounded by the insulator; a second electrical contact provided at a lower inner surface of the main cell while being arranged in the primary combustion chamber, the second electrical contact corresponding to the first electrical contact; a cross flame ignition valve having a dish-shaped structure such that the cross flame ignition valve covers the first and second electrical contacts beneath the first and second electrical contacts, the cross flame ignition valve having a main ignition hole and auxiliary ignition holes arranged at a lower central region of the primary combustion chamber; and a heat transfer member interposed between the main cell and the insulator, to transfer heat caused by flames generated during an ignition operation of the first and second electrical contacts to an external of the ignition plug and to cut off leakage of volatile gas.

The heat transfer member may be made of an alloy of copper and aluminum. The first and second electrical contacts may be made of a platinum-based alloy.

The cross flame ignition valve may be made of a zirconium-based alloy. Alternatively, the cross flame ignition valve may be made of Inconnel 601.

The total number of the main ignition hole and the auxiliary ignition holes may be three or more under a condition in which the total cross-sectional area of the main ignition hole and the auxiliary ignition holes ranges from 1/400 to 1/700 of the cross-sectional area of the cylinder.

The cross flame ignition valve may have an inclination of 15 to 20 in a downward direction from a horizontal line of the rim portion.

In accordance with still another aspect, the present invention provides an ignition plug comprising: a main cell having a bendable extension part formed at a lower end of the main cell, and a hollow portion defined in an interior of the main cell; a central electrode centrally arranged in the main cell; an insulator surrounding a body of the central electrode, the insulator defining a primary combustion chamber for pre-ignition of a gas mixture, together with a lower inner wall surface of the main cell; a heat transfer member interposed between the inner wall surface of the main cell and the insulator, to transfer high-temperature heat generated in the primary combustion chamber to an external of the ignition plug; and a cross flame ignition valve for guiding flames from the primary combustion chamber to an interior of a cylinder.

The cross flame ignition valve may be coupled to the lower end of the main cell by the extension part in a bent state of the extension part under a condition in which the cross flame ignition valve is arranged at a step defined between the extension part and the lower end of the main cell.

The heat transfer member may comprise a first heat transfer member arranged at an upper end of the primary combustion chamber, and a second heat transfer member arranged between an upper inner wall surface of the main cell and the insulator.

Advantageous Effects

The above-described ignition plug according to the present invention has the following effects.

First, the cross flame ignition valve is not deformed even under high-temperature and high-pressure conditions because it is manufactured using a zirconium-based alloy. Accordingly, there are advantages in that it is possible to increase the life span of the ignition plug and to prevent abnormal ignition caused by high-temperature heat.

Second, there is an advantage in that it is possible to easily transfer high-temperature heat generated in the primary combustion chamber to the external of the ignition plug by virtue of the heat transfer member interposed between the inner wall surface of the main cell and the insulator. It is also possible to prevent flames from being leaked through a gap defined between the main cell and the insulator.

Third, there is an advantage of easy assembly of the ignition plug because the cross flame ignition valve is coupled to the lower end of the main cell by simply bending the extension part.

Fourth, it is possible to increase the combustion rate of the gas mixture because the cross flame ignition valve has high resistance to high temperature. In accordance with the increased gas mixture combustion rate, it is possible to obtain high engine output power. There is also an advantage in that it is possible to enable delayed ignition in the overall stroke of the engine. In addition, there are advantages of an extended life span of engine oil, a reduction in the noise and vibration generated in the engine, and a reduction in the emission of exhaust gas, in particular, nitrogen oxides.

BEST MODE FOR CARRYING OUT THE INVENTION

The accompanying drawings, which are included to provide a further understanding of the invention, illustrate embodiments of the invention and together with the description serve to explain the principle of the invention.

In the drawings:

FIG. 1 is a sectional view illustrating the ignition plug according to the present invention;

FIG. 2 is an enlarged sectional view illustrating a coupled state of a cross flame ignition valve included in the ignition plug of FIG. 1 in accordance with an embodiment of the present invention; and FIG. 3 is an enlarged sectional view illustrating a coupled state of a cross flame ignition valve included in the ignition plug in accordance with another embodiment of the present invention.

Reference will now be made in detail to preferred embodiments of an ignition plug according to the present invention, examples of which are illustrated in the accompanying drawings. FIG. 1 is a sectional view illustrating the ignition plug according to the present invention. FIG. 2 is an enlarged sectional view illustrating a state in which a cross flame ignition valve according to the present invention is coupled to a bent portion of a main cell.

The ignition plug includes a main cell 110 having a hollow structure, an insulator 120 arranged in the main cell 110, and a cross flame ignition valve 150 arranged at a lower end of the main cell 110.

A central electrode 130 is arranged in a central portion of the main cell 110. In particular, the central electrode 130 is fitted in a central portion of the insulator 120. The central electrode 130 is coupled to a terminal rod 170 which extends upwardly from the central electrode 130. Heat transfer members 160 and 161 are interposed between an inner wall surface of the main cell 110 and the insulator 120 at pre-determined positions, respectively.

The insulator 120 surrounds the terminal rod 170 and central electrode 130 embedded in the central portion of the main cell 110, to insulate the terminal rod 170 and central electrode 130 from the main cell 110.

The main cell 110 has an extension part 114 formed at a lower end of the main cell 110, to provide a coupling space in which the cross flame ignition valve 150 is coupled to the main cell 110. The main cell 110 also has a lower main cell wall 112 extending upwardly from the extension part 114 while being stepped from the extension part 114, to form a lower portion of the main cell 110. The lower main cell wall 112 defines a primary combustion chamber 111 for pre-igniting a gas mixture. The main cell 110 further has an upper main cell wall 115 forming an upper portion of the main cell 110, and an intermediate main cell wall 113 arranged between the upper main cell wall 115 and the lower main cell wall 112.

Meanwhile, the hollow structure of the main cell 110 has a cross-section varying along the axial length of the main cell 110. In detail, the cross-sectional area of the main cell 110 in the space defined by the extension part 114 is larger than the cross-sectional area in the space defined by the lower main cell wall 112. The cross-sectional area in the space defined by the intermediate main cell wall 113 is larger than the cross-sectional area in the space defined by the lower main cell wall 112. The cross-sectional area in the space defined by the upper main cell wall 115 is larger than the cross-sectional area in the space defined by the intermediate main cell wall 113. The insulator 120 has a cross-section variation substantially similar to that of the main cell 110, to conform to the hollow structure of the main cell 110.

The reason why the hollow structure of the main cell 110 has a cross-section variation as described above is to easily form the primary combustion chamber 111 at the lower portion of the main cell 110, and to easily transfer heat caused by flames generated in the primary combustion chamber 111.

The extension part 114, which is arranged at the lower end of the main cell 110, is bendable to couple the cross flame ignition valve 150 to the main cell 110. In detail, the extension part 114 is radially outward stepped from the inner surface of the lower main cell wall 112, and is radially inward bent in a process for coupling the cross flame ignition valve 150.

In order to couple the cross flame ignition valve 150 to the main cell 110, the cross flame ignition valve 150 is first inserted into the space defined by the extension part 114. Thereafter, the extension part 114 is bent toward the central axis of the ignition plug such that the bent extension part 114 is engaged with a peripheral portion of the cross flame ignition valve 150. Thus, the cross flame ignition valve 150 is coupled to the lower end of the main cell 110.

As described above, the primary combustion chamber 111 is defined within the lower main cell wall 112. In the primary combustion chamber 111, a body of the central electrode 130 is arranged in a state of being surrounded by the insulator 120. A first electrical contact 132 for ignition is formed at an outer surface of a lower end of the central electrode 130.

A second electrical contact 142 corresponding to the first electrical contact 132 is formed at the inner surface of the lower main cell wall 112. Accordingly, the lower main cell wall 112 may be referred to as a ground electrode corresponding to the central electrode 130. The central electrode 130, which is centrally arranged in the insulator 120, is connected to an external voltage terminal. Accordingly, the first electrical contact 132 formed at the central electrode 130 electrically interacts with the second electrical contact 142 formed at the inner surface of the lower main cell wall 112.

The first and second electrical contacts 132 and 142 are arranged within the primary combustion chamber 111 such that they are spaced apart from each other by a pre-determined distance while facing each other. Preferably, the first and second electrical contacts 132 and 142 are made of platinum or a platinum-based alloy. Threads are formed on an outer surface of the lower main cell wall 112, to fasten the ignition plug to an engine.

Since the insulator 120 is filled in the interior of the intermediate main cell wall 113, the primary combustion chamber 111 is insulated from the upper main cell wall 115. That is, the inner surface of the intermediate main cell wall 113 is directly in contact with the insulator 120.

The upper main cell wall 115 is smoothly enlarged as it extends toward the intermediate main cell wall 113. A first one of the heat transfer members, namely, the heat transfer member 160, is arranged at a region where the upper main cell wall 115 and intermediate main cell wall 113 are connected. In detail, the first heat transfer member 160 has a ring shape, and is interposed between the inner surface of the upper main cell wall 115 and the outer surface of the insulator 120.

A second one of the heat transfer members, namely, the heat transfer member 161, is arranged at an upper end of the primary combustion chamber 111. The second heat transfer member 161 has a ring shape, and is interposed between the outer surface of the insulator 120 and the inner surface of the intermediate main cell wall 113. The second heat transfer member 161 transfers high-temperature heat generated from flames in the primary combustion chamber 111 to the external of the ignition plug. The second heat transfer member 161 also functions to cut off leakage of volatile gas present in the primary combustion chamber 111.

The first heat transfer member 160 functions to transfer high-temperature heat generated in the primary combustion chamber 111 to the external of the ignition plug. Preferably, the heat transfer members 160 and 161 are made of an alloy of copper and aluminum.

In accordance with another embodiment of the present invention, only one of the first and second heat transfer members 160 and 161 may be installed. Alternatively, a plurality of heat transfer members may be installed at different positions, respectively. The heat transfer members may be in contact with the inner surface of the main cell while enclosing the insulator 120 arranged within the intermediate main cell wall 113 and upper main cell wall 115.

The cross flame ignition valve 150 has a dish shape, and is arranged at the lower end of the main cell 110 beneath the first and second electrical contacts 132 and 142 while covering the first and second electrical contacts 132 and 142. In detail, the cross flame ignition valve 150 has a ring-shaped rim portion 151 and a disc-shaped central portion having a height lower than that of the rim portion 151. The cross flame ignition valve 150 also has an inclined portion 155 connecting the rim portion 151 and central portion 153.

The inclined portion 155 is downwardly inclined from the rim portion 151 toward the central portion 153. The inclination of the inclined portion 155 is 15 to 20 in a downward direction with reference to the rim portion 151.

A main ignition hole 152 is formed through the central portion 153, to communicate the primary combustion chamber 111 with the interior of a cylinder. Preferably, the main ignition hole 152 is formed at a position approximately corresponding to the central position of the primary combustion chamber 111.

Auxiliary ignition holes 154 are formed through the inclined portion 155 at positions arranged on a circle radially spaced apart from the center of the main ignition hole 152 by a predetermined distance, respectively. Of course, the auxiliary ignition holes 154 communicate the primary combustion chamber 111 with the interior of the cylinder. The auxiliary ignition holes 154 also function to enable flames generated in the primary combustion chamber 111 to flow smoothly into the interior of the cylinder. The auxiliary ignition holes 154 may be symmetrically arranged at a predetermined level from the main ignition hole 152. Alternatively, the auxiliary ignition holes 154 may be asymmetrically arranged at different levels, respectively. The auxiliary ignition holes 154 may also be formed at the central portion 153.

The cross flame ignition valve 150 is made of a material containing zirconium or a zirconium-based alloy as a major component thereof. Other known alloy materials may be used, depending on the engine, to which the ignition plug according to the present invention is applied. For example, Inconnel 601 may be used. However, such alloy materials cannot be coupled to the main cell, which is made of carbon steel, using a welding process. To this end, the above-described coupling structure is used in accordance with the present invention.

Where the cross flame ignition valve 150 is manufactured using Inconnel 601, it is preferred that the thickness of the cross flame ignition valve 150 be on the order of about 0.5 to 1 mm.

The cross flame ignition valve 150 has an inclination of about 15 to 20 in a downward direction with reference to the rim portion 151. Preferably, the total number of the main ignition hole 152 and auxiliary ignition holes 154 is three or more under the condition in which the total cross-sectional area of the main ignition hole 152 and auxiliary ignition holes 154 ranges from 1/400 to 1/700 of the cross-sectional area of the cylinder.

The following is a result of a comparison made for cases respectively using a conventional ignition plug and the ignition plug according to the present invention in terms of the amount of exhaust gas, in particular, the amount of nitrogen oxides.

For this comparison, a vehicle using a 2,000 cc-grade 4-cylinder engine was tested under the condition in which a three-way catalytic converter was removed. In the case using the conventional ignition plug 126 ppm, 554 ppm, and 814 ppm of nitrogen oxides were detected at 750 rpm, 1,600 rpm, and 2,600 rpm of the engine speed, respectively. On the other hand, in the case using the ignition plug according to the present invention, 69 ppm, 180 ppm, and 386 ppm of nitrogen oxides were detected at 750 rpm, 1,600 rpm, and 2,600 rpm of the engine speed, respectively.

Referring to the result of the test, it can be seen that the case using the ignition plug according to the present invention exhibits reduced emission of nitrogen oxides by 45 to 68%, as compared to the case using the conventional ignition plug.

Hereinafter, operation of the ignition plug according to the present invention will be described with reference to FIGS. 1 and 2.

During the compression stroke of the engine, a gas mixture is partially introduced into the primary combustion chamber 111 via the main ignition hole 152 and auxiliary ignition holes 154. The gas mixture in the primary combustion chamber 111 is pre-burned by sparks generated between the first and second electrical contacts 132 and 142 arranged in the primary combustion chamber 111, at the point of time earlier than a top dead center (TDC) of the compression stroke.

As a result, high-pressure flames generated in the primary combustion chamber 111 are introduced into the cylinder via the main ignition hole 152 and auxiliary ignition hole 154. This is because the pressure of the primary combustion chamber 111 where the high-pressure flames are generated is relatively higher than the internal pressure of the cylinder. The flames injected into the cylinder ignite the gas mixture compressed to the TDC of the compression stroke within the cylinder. As a result, engine power is generated.

Another embodiment of the cross flame ignition valve included in the ignition plug according to the present invention will be described with reference to FIG. 3.

In accordance with this embodiment, the cross flame ignition valve 150 has a rim portion 151 coupled with the bent extension part 114 of the main cell, and a central portion 153 extending radially inward from the rim portion 151. The central portion 153 has a cross-section forming a smoothly curved surface. A main ignition hole 152 and auxiliary ignition holes 154 are formed through the central portion 153, to communicate the primary combustion chamber with the interior of the cylinder.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

INDUSTRIAL APPLICABILITY

As apparent from the above description, the ignition plug according to the present invention can achieve an increase in gas mixture burning rate and instantaneous complete combustion of the gas mixture in the cylinder because the ignition plug uses a cross flame ignition valve made of zirconium or a zirconium-based alloy suitable for use in high-temperature environments. Accordingly, it is possible to reduce emission of pollutants such as nitrogen oxides. Thus, when the ignition plug according to the present invention is used, it is possible to manufacture an environmentally-friendly internal combustion engine exhibiting an excellent combustion efficiency, namely, an excellent energy efficiency.

What is claimed is:

1. An ignition plug comprising:

a hollow main cell having a primary combustion chamber defined in an interior of the main cell, and a bendable extension part formed at a lower end of the main cell;

an insulator mounted in a hollow portion of the main cell, to insulate a terminal rod centrally embedded in the main cell;

a central electrode having a first electrical contact arranged in the primary combustion chamber, the central electrode extending downwardly from the terminal rod while being surrounded by the insulator;

a second electrical contact provided at a lower inner surface of the main cell while being arranged in the primary combustion chamber, the second electrical contact corresponding to the first electrical contact;

a cross flame ignition valve having a dish-shaped structure such that the cross flame ignition valve covers the first and second electrical contacts beneath the first and second electrical contacts, the cross flame ignition valve having a main ignition hole and auxiliary ignition holes arranged at a lower central region of the primary combustion chamber; and a heat transfer member interposed between the main cell and the insulator, to transfer heat caused by flames generated during an ignition operation of the first and second electrical contacts to an external of the ignition plug and to cut off leakage of volatile gas.

2. The ignition plug according to claim 1, wherein the heat transfer member is made of an alloy of copper and aluminum.

3. The ignition plug according to claim 1, wherein the first and second electrical contacts are made of a platinum-based alloy.

4. The ignition plug according to claim 1, wherein the cross flame ignition valve is made of a zirconium-based alloy.

5. The ignition plug according to claim 1, wherein the cross flame ignition valve is made of Inconnel 601.

6. The ignition plug according to claim 1, wherein a total number of the main ignition hole and the auxiliary ignition holes is three or more under a condition in which a total cross-sectional area of the main ignition hole and the auxiliary ignition holes ranges from 1/400 to 1/700 of a cross-sectional area of the cylinder.

7. The ignition plug according to claim 1, wherein the cross flame ignition valve has an inclination of 15 to 20 in a downward direction from a horizontal line of the rim portion.

8. An ignition plug comprising:

a main cell having a bendable extension part formed at a lower end of the main cell, and a hollow portion defined in an interior of the main cell;

a central electrode centrally arranged in the main cell;

an insulator surrounding a body of the central electrode, the insulator defining a primary combustion chamber for pre-ignition of a gas mixture, together with a lower inner wall surface of the main cell;

a heat transfer member interposed between the inner wall surface of the main cell and the insulator, to transfer high-temperature heat generated in the primary combustion chamber to an external of the ignition plug; and a cross flame ignition valve for guiding flames from the primary combustion chamber to an interior of a cylinder.

9. The ignition plug according to claim 8, wherein the cross flame ignition valve is coupled to the lower end of the main cell by the extension part in a bent state of the extension part under a condition in which the cross flame ignition valve is arranged at a step defined between the extension part and the lower end of the main cell.

10. The ignition plug according to claim 8, wherein the heat transfer member comprises a first heat transfer member arranged at an upper end of the primary combustion chamber, and a second heat transfer member arranged between an upper inner wall surface of the main cell and the insulator.

11. The ignition plug according to any one of claim 8 to 10, wherein the cross flame ignition valve is made of a zirconium-based alloy.

* * * * *